US008784126B2

(12) United States Patent
Chang

(10) Patent No.: US 8,784,126 B2
(45) Date of Patent: Jul. 22, 2014

(54) LOCKING SOCKET

(71) Applicant: Chi-Tsai Chang, Taichung (TW)

(72) Inventor: Chi-Tsai Chang, Taichung (TW)

( * ) Notice: Subject to any disclaimer, the term of this patent is extended or adjusted under 35 U.S.C. 154(b) by 65 days.

(21) Appl. No.: 13/691,741

(22) Filed: Dec. 1, 2012

(65) Prior Publication Data

US 2013/0143428 A1 Jun. 6, 2013

(30) Foreign Application Priority Data

Dec. 6, 2011 (TW) ..... 100222980 U

(51) Int. Cl.
*H01R 13/627* (2006.01)

(52) U.S. Cl.
CPC ..... *H01R 13/6275* (2013.01)
USPC ..... 439/358

(58) Field of Classification Search
CPC ..... H01R 13/6275; H01R 13/62933
USPC ..... 439/358, 357, 372
See application file for complete search history.

(56) References Cited

U.S. PATENT DOCUMENTS

| | | | | |
|---|---|---|---|---|
| 6,186,819 | B1 * | 2/2001 | Holub | 439/358 |
| 6,371,789 | B1 * | 4/2002 | Sato et al. | 439/358 |
| 7,393,234 | B1 * | 7/2008 | Chien et al. | 439/372 |
| 7,575,464 | B2 * | 8/2009 | Kobayashi et al. | 439/358 |

* cited by examiner

*Primary Examiner* — Phuong Dinh

(57) ABSTRACT

A locking socket includes a shell and a buckle mechanism. The shell forms a slot and plug holes adapted for receiving a plug. The buckle mechanism is pivotably disposed to the shell and is exposed out of the shell via the slot. The buckle mechanism further forms a buckle portion which is able to alternatively lock on or release the plug when the buckle mechanism pivots so that the locking socket of the present invention is adapted for the plug to insert in. Also, the buckle mechanism alternatively abuts against the plug to prevent the plug from detachment. Thereby, the present invention provides a locking socket with simpler structure, improved structure intensity, and better positioning.

11 Claims, 7 Drawing Sheets

LOCKING SOCKET

BACKGROUND OF THE INVENTION

1. Field of the Invention

The present invention relates to a socket, more specifically to a socket which is able to prevent plugs from detachment.

2. Description of the Prior Art

Conventional sockets are usually designed to hook on or connect with a plug to prevent the plug from detaching. For example, the sockets disclosed in U.S. Pat. Nos. 5,593,313 and 7,850,478 have buckle elements formed by bent wires, and the buckle elements pivot to hook on the plug.

However, the previous sockets position the plug weakly. If the plug is pulled out more heavily, the plug may be detached accidentally easily.

SUMMARY OF THE INVENTION

The main object of the present invention is to provide a socket which has simple structure and is able to position plugs.

To achieve the above and other objects, a locking socket is provided in the present invention. The locking socket is adapted for receiving a plug having a pin and a cover wherein the cover surrounds the pin. The locking socket of the present invention includes a shell and a buckle mechanism.

The shell has a top face. A plurality of plug holes are formed recessedly from the top face and are adapted for the pin to insert therein. The shell further forms a slot recessed from the top face. The slot is separated from the plug holes to prevent from being covered by the plug.

The buckle mechanism has a pivot portion, a connecting portion, and a buckle portion. The connecting portion connects the pivot portion to the buckle portion. The pivot portion is rotatably disposed to the shell and is able to rotate around an axis. The pivot portion is located below the top face. The connecting portion is pivotably disposed in the slot. The buckle portion is located above the top face so that the buckle mechanism is able to pivot between a first position and a second position. When the buckle mechanism pivots toward the first position, the buckle portion move toward the plug holes so that the buckle portion is adapted for abutting against the plug.

Preferably, the shell forms a groove recessed from the top face. The groove surrounds the plug holes and communicates with the slot. The groove is adapted for the cover of the plug to insert therein. The pivot portion is separated from the top face by a predetermined distance so that the pivot portion is located below the cover when the cover is inserted into the groove.

Thereby, the locking socket of the present invention is adapted for receiving plugs and is able to prevent plugs from detaching due to the buckle mechanism abutting against the plugs. Thus, the locking socket of the present invention has a simple structure and is able to position better.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 2:
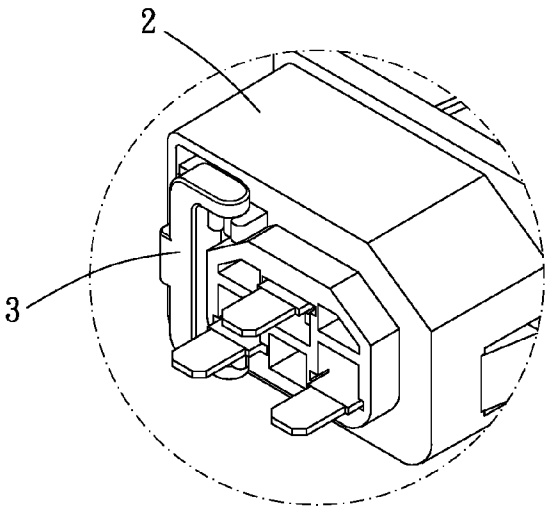
FIG. 2 is a stereogram at another angle of the present invention.
Figure 1:
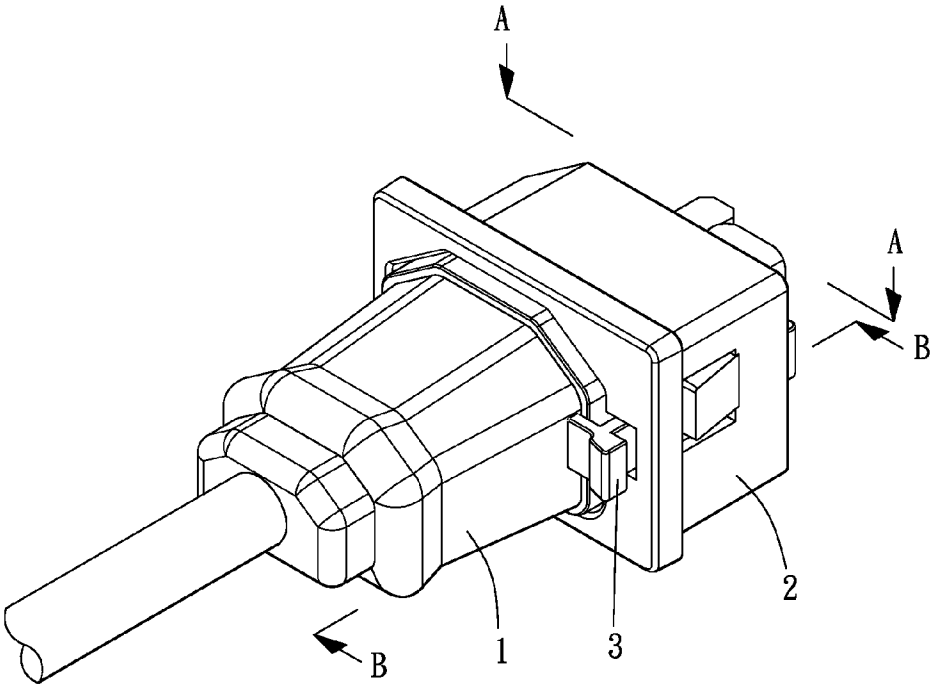
FIG. 1 is a stereogram of the present invention.
Figure 3:
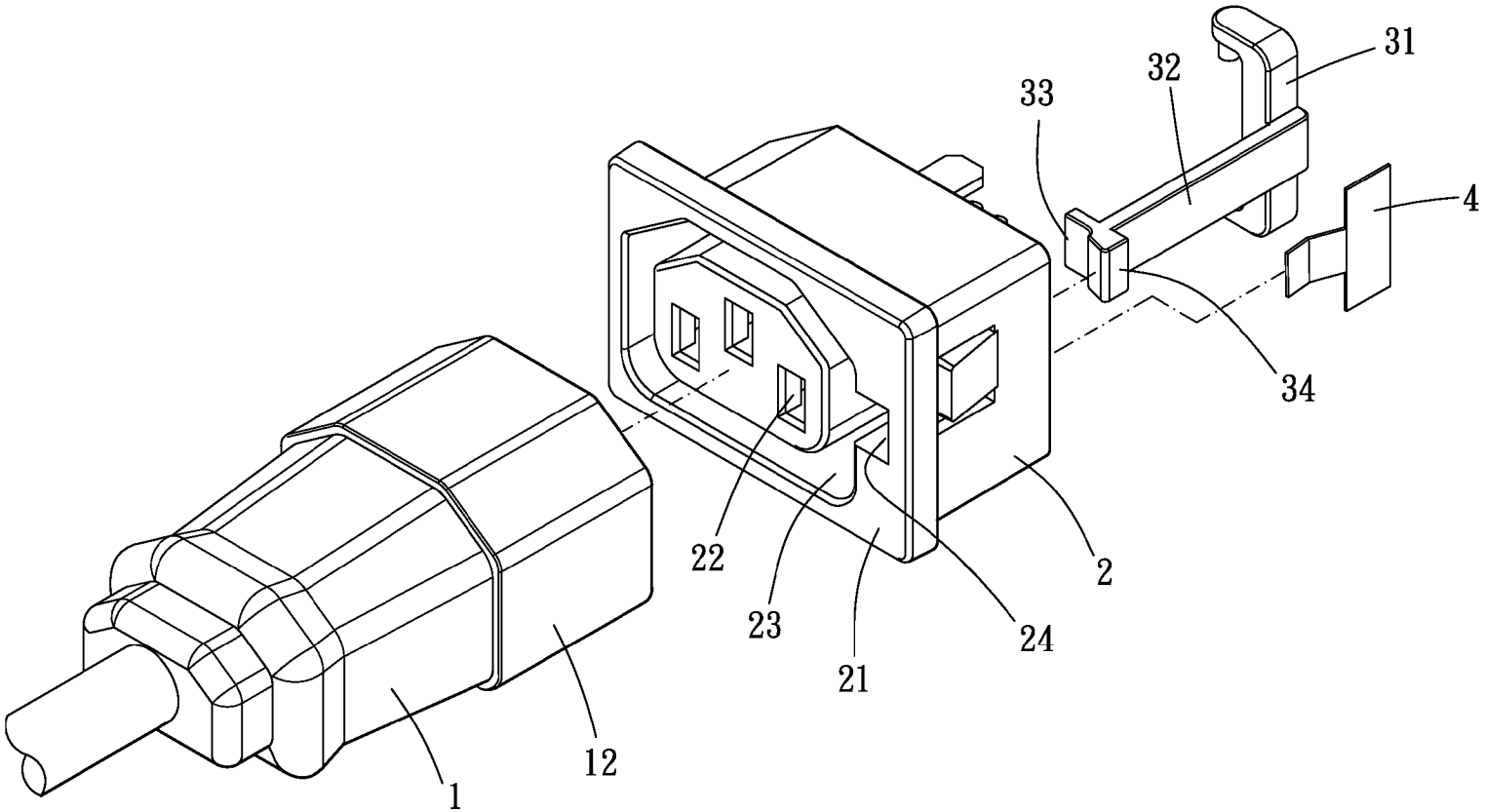
FIG. 3 is a breakdown drawing of the present invention.
Figure 4:
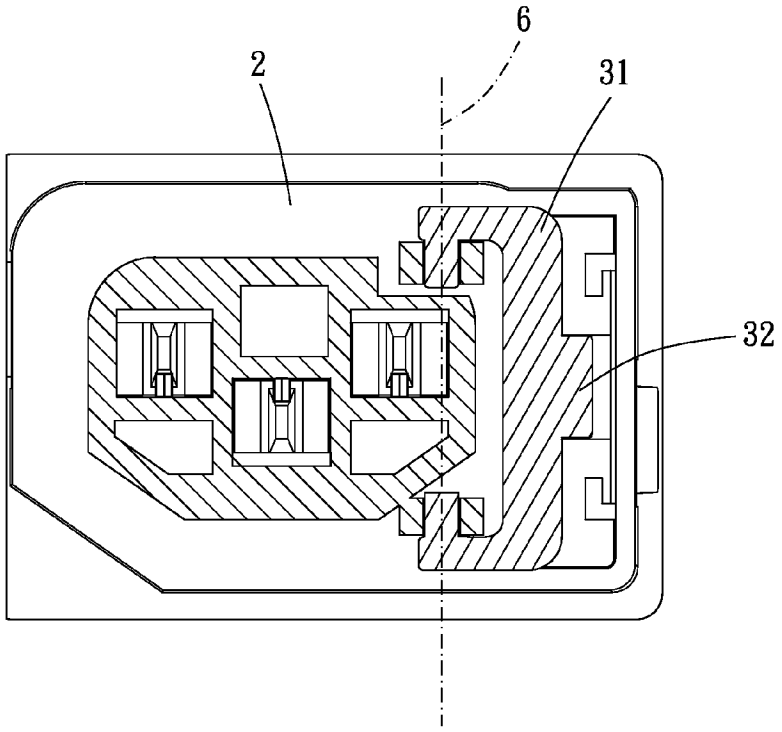
FIG. 4 is a profile of A-A of FIG. 1 of the present invention.

Please refer to FIG. 1 to FIG. 5. The locking socket of the present invention is adapted for receiving a plug 1 having a pin 11 and a cover 12 wherein the cover 12 surrounds the pin 11. However, the present invention can be utilized with plugs without cover. The locking socket includes a shell 2 and a buckle mechanism 3. Also, the locking socket further includes a repositioning mechanism 4.

Figure 5:
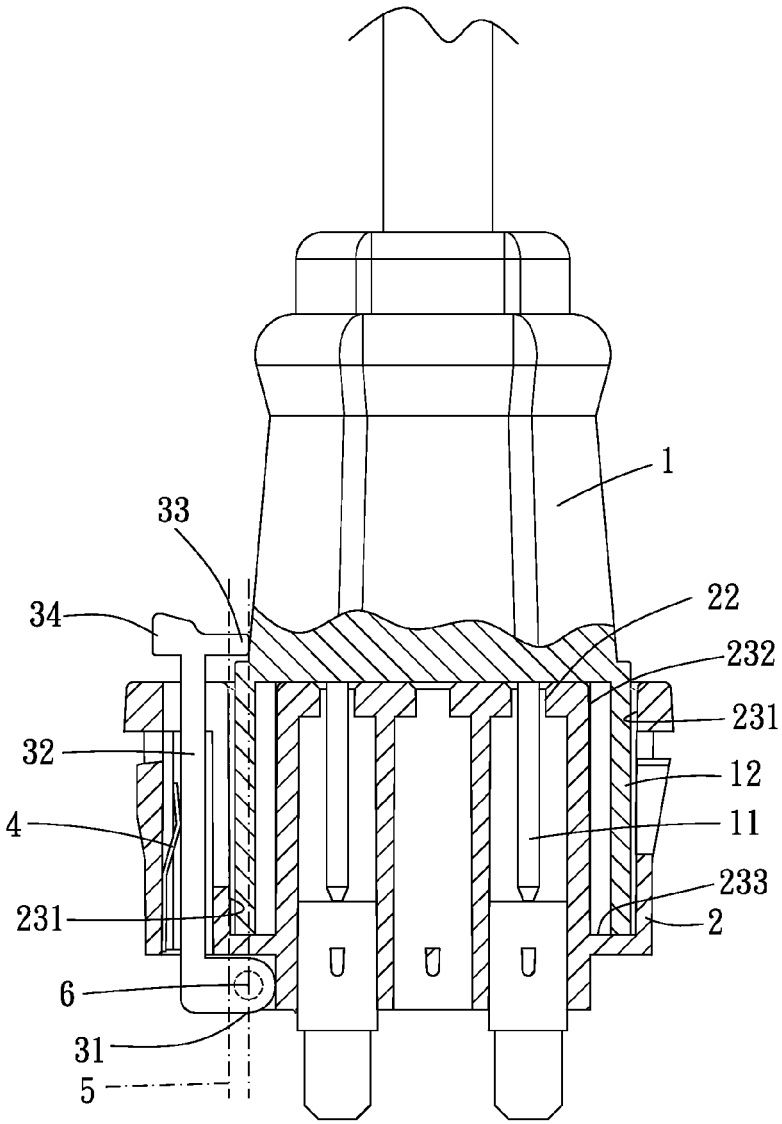
FIG. 5 is a profile of B-B of FIG. 1 of the present invention.

The shell 2 has a top face 21. The shell 2 forms a plurality of plug holes 22 recessed from the top face 21, a groove 23, and a slot 24. The plug holes 22 are adapted for the pin 11 of the plug 1 to insert therein so that the pin 11 is able to connect with a power terminal in the plug holes 22 for electricity transmission. The groove 23 surrounds the plug holes 22 and has a shape corresponding to the cover 12 to receive the cover 12 of the plug 1. The groove 23 communicates with the slot 24. The slot 24 is located at a side of the shell 2 having the plug holes 22 and is separated from the plug holes 22 to prevent from being covered by the plug 1. More specifically, the plug holes 22 are surrounded by the groove 23, and the slot 24 is located outside the groove 23. Referring to FIG. 5, the groove 23 has an outer surface 231, an inner surface 232, and a bottom face 233. For defining positions of other components, a standard plane 5 is defined by an extension of the outer surface 231 of the groove 23.

The buckle mechanism 3 has a pivot portion 31, a connecting portion 32, and a buckle portion 33, and moreover a protrusion 34. The connecting portion 32 connects the pivot portion 31 to the buckle portion 33. More specifically, the pivot portion 31 is C-shaped. The pivot portion 31 is rotatably disposed to the shell 2 and is located below the top face 21, more preferably inside a range defined by the top face 21. The pivot portion 31 is able to rotate around an axis 6 so that the buckle mechanism 3 is pivotable with respect to the shell 2. Furthermore, the pivot portion 31 is separated from the top face 21 of the shell 2 by a predetermined distance, as shown in FIG. 5, so that the pivot portion 31 is located below the cover 12 when the cover 12 is inserted in the groove 23. Thus, the pivot portion 31 is disposed at a bottom of the shell 2. The connecting portion 32 is rod-shaped and extends from an intermediate section of the pivot portion 31, and the connecting portion 32 is rotatably inserted in the slot 24 and is exposed above the top face 21 of the shell. The buckle portion 33 protrudes and bends from a terminal end of the connecting portion 32 so that the buckle portion 33 is located above the top face 21 of the shell. Specifically, the buckle portion 33 and the pivot portion 31 are located at an end of the connecting portion 32 near the plug holes 22. The protrusion 34 protrudes from the buckle portion 33 away from an end of the buckle portion having the plug holes 22 so that the buckle mechanism 3 is adapted for a user to press.

Figure 6:
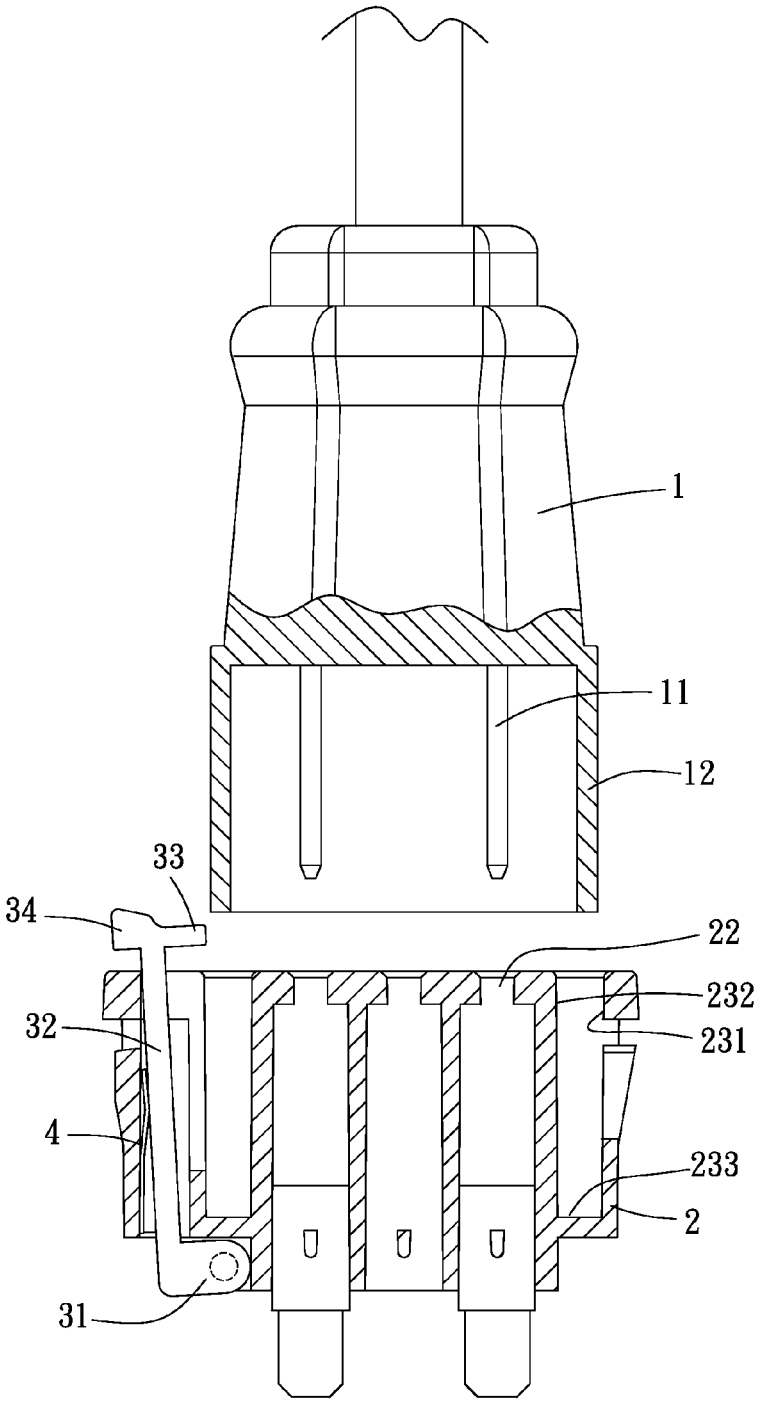
FIG. 6 is an illustration of the present invention.
Figure 7:
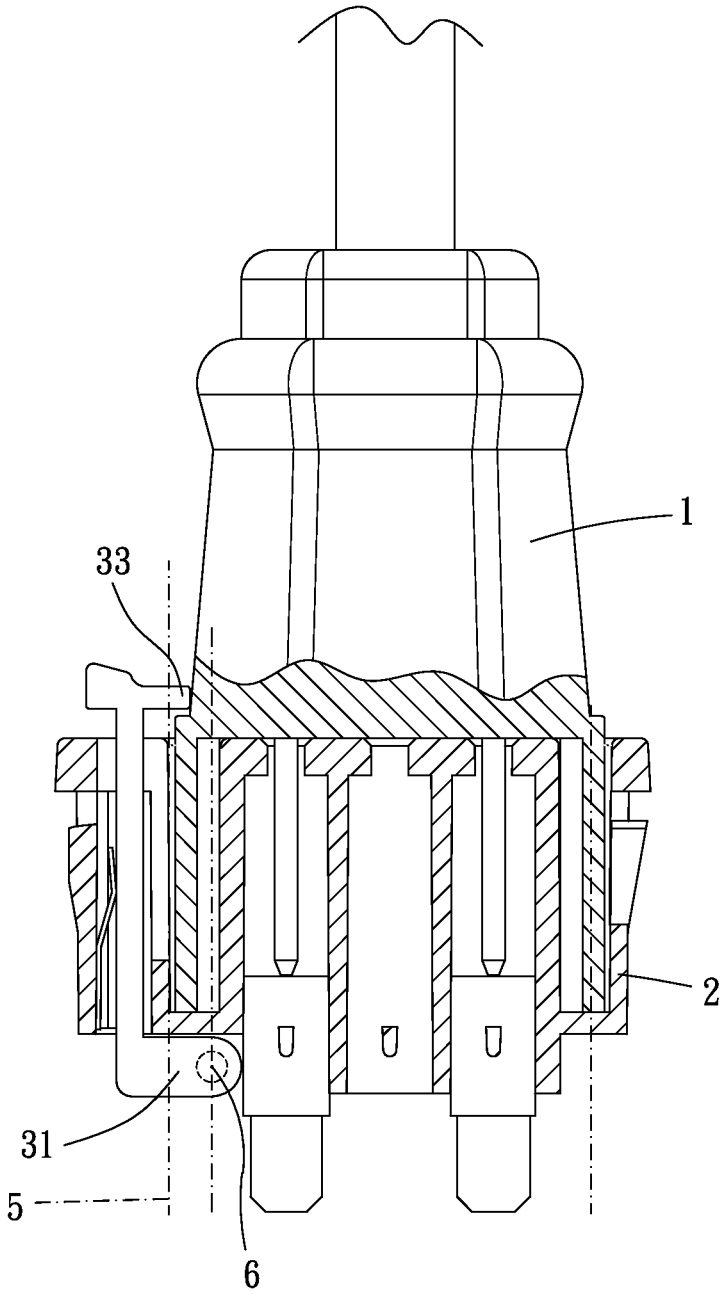
FIG. 7 is a profile showing a second embodiment of the present invention.

Please refer to FIGS. 5 and 6, the buckle mechanism is able to pivot with respect to the shell 2 between a first position and a second position. As shown in FIG. 5, when the buckle mechanism is located at the first position or moves toward the first position, the buckle portion 33 of the buckle mechanism move toward the plug holes 22 so that the buckle portion is able to abut against the plug 1, more preferably a rear end of the cover 12 of the plug 1, or other protrusions on a common plug. When the buckle mechanism is located at the second position, as shown in FIG. 6, the buckle portion 33 is separated from the plug 1 so that the plug 1 is able to be detached from the shell 2. More specifically, when the buckle mechanism is located at the first position, as shown in FIG. 5, the buckle portion 33 and the pivot portion 31 are located on the standard plane 5 or inside the standard plane 5. Please refer to FIG. 7, in a second embodiment of the present invention, the pivot portion 31 extends inward by longer distance so that a length of the axis 6 of the pivot portion 31 inserted into the standard plane 5 is larger than a length of the buckle portion 33 inserted into the standard plane 5. However, it is feasible that the length of the pivot portion 31 inserted into the standard plane 5 is equal to a length of the buckle portion 33 inserted into the standard plane 5 in the first embodiment of the present invention.

The repositioning mechanism 4 abuts against the buckle mechanism 3 so that the buckle mechanism 3 tends to return to the first position. More specifically, the repositioning mechanism 4 is an elastic piece formed by a bent metal piece, or other elastic elements. The repositioning mechanism 4 is disposed between the shell 2 and the connecting portion 32 of the buckle mechanism and abuts thereagainst. Also, the repositioning mechanism 4 is located at a side of the connecting portion 32 away from the plug holes 22 so as to push the buckle mechanism 3 toward the first position.

In use, please refer to FIG. 5, the plug 1 is inserted into the shell 2. The buckle mechanism is pushed to the first position by the repositioning mechanism 4 so that the buckle portion 33 is positioned to the plug 1 to prevent the plug 1 from detachment. To facilitate insertion of the plug 1, a side of the buckle portion 33 away from the top face of the shell can be processed by chamfering or other similar process so that the buckle portion 33 and the buckle mechanism may move toward the second position when the plug 1 is inserted in. Please refer to FIG. 6, when the plug 1 is to be detached, a user can press the protrusion 34 of the buckle mechanism to move the buckle mechanism toward the second position so that the buckle portion 33 can be detached from the plug 1 to release the plug 1.

Figure 8:
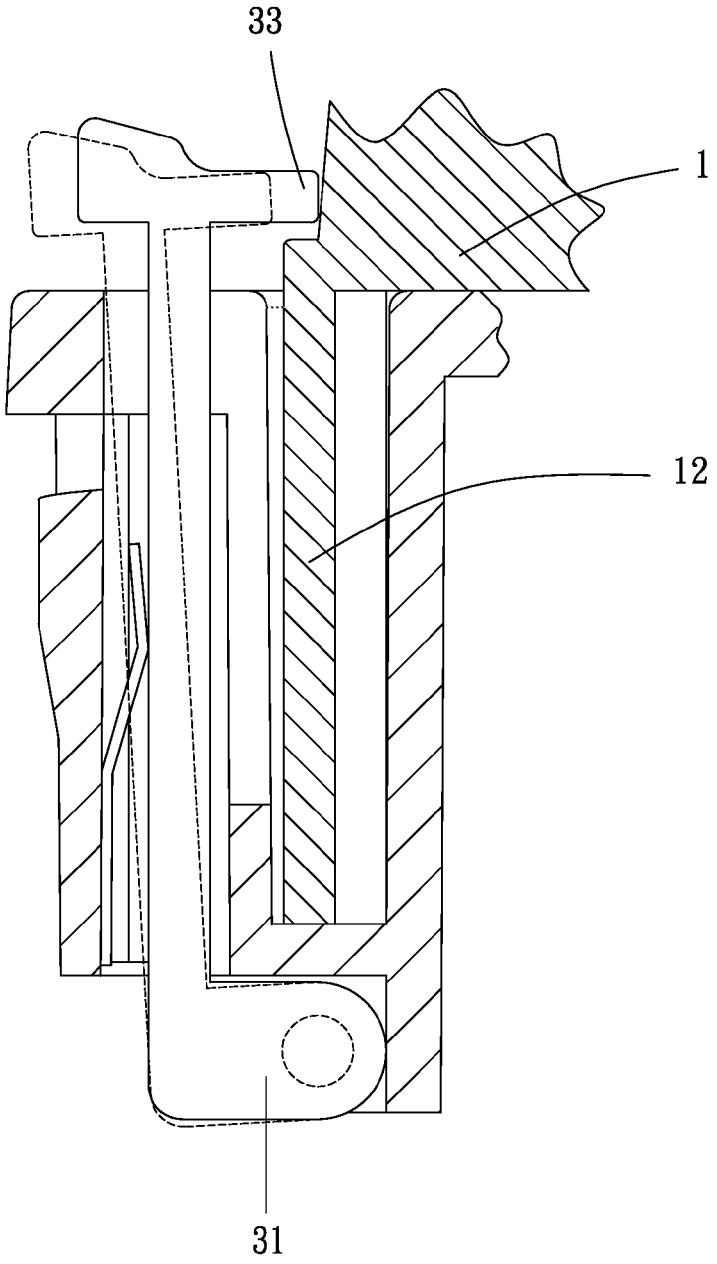
FIG. 8 is a partial enlargement of FIG. 5.

In the present invention, the buckle portion and the pivot portion can be disposed at a side of the connecting portion near the plug holes so that the buckle mechanism can position more firmly. Please refer to FIG. 8, when the buckle mechanism is moving from the first position toward the second position, the buckle portion 33 moves only downward and outward instead upward. When the buckle portion 33 hooks on the plug 1, the buckle portion 33 and the buckle mechanism may not be moved toward the second position even if the plug 1 is pulled upward. Only when the buckle mechanism is moved toward the second position to separate the buckle portion 33 from the plug 1, the plug 1 is able to be pulled out upward. Thus, better positioning is provided.

Furthermore, the pivot portion 31 can be disposed at a more interior position inside the standard plane 5. The pivot portion 31 is disposed more interior, the length of the axis 6 inserted into the standard plane 5 is larger. Thus, the buckle portion 33 is deviated from the axis 6. Thereby, when the buckle mechanism pivots, the buckle portion moves more downward. The buckle mechanism 3 is thereby able to connect with the plug more firmly.

On the other hand, the rod-shaped connecting portion 32 promotes structure intensity and prevents the buckle mechanism from deforming. Thus, the plug is prevented from detaching accidentally.

Besides, in other possible embodiments, the slot and the buckle mechanism can be disposed at two opposite sides of the shell for further improving structure intensity.

What is claimed is:

1. A locking socket, adapted for receiving a plug having a pin and a cover wherein the cover surrounding the pin, the locking socket including:

a shell, having a top face, the shell forming a plurality of plug holes recessed from the top face, the plug holes being adapted for receiving the pin of the plug, the shell further forming slot recessed from the top face, the slot being separated from the plug holes so as to prevent from covered by the plug;

a buckle mechanism, having a pivot portion, a connecting portion, and a buckle portion, the connecting portion connecting the pivot portion to the buckle portion, the pivot portion being rotatably disposed to the shell and being able to rotate around an axis, the pivot portion being located below the top face, the connecting portion being pivotably inserted in the slot, the buckle portion being located above the top face so that the buckle mechanism is able to pivot between a first position and a second position, the buckle portion moving toward the plug holes when the buckle mechanism pivot toward the first position so that the buckle portion is able to be abutted by the plug;

wherein the shell forms a groove recessed from the top face, the groove surrounds the plug holes and communicates with the slot, the groove is adapted for the cover of the plug to insert therein, the pivot portion is separated from the top face by a predetermined distance so that the pivot portion is located below the cover when the cover is inserted in the groove.

2. The locking socket of claim 1, wherein the pivot portion is located below a bottom face of the groove.

3. The locking socket of claim 1, wherein the buckle portion and the pivot portion are located at a side of the connecting portion near the plug holes.

4. The locking socket of claim 2, wherein a standard plane is defined by an extension of an outer surface of the groove, the buckle portion and the pivot portion are located on or inside the standard plane.

5. The locking socket of claim 3, wherein a standard plane is defined by an extension of an outer surface of the groove, the buckle portion and the pivot portion are located on or inside the standard plane.

6. The locking socket of claim 4, wherein a length of the axis of the pivot portion extending into the standard plane is larger than a length of the buckle portion extending into the standard plane when the buckle mechanism is located at the first position.

7. The locking socket of claim 5, wherein a length of the axis of the pivot portion extending into the standard plane is larger than a length of the buckle portion extending into the standard plane when the buckle mechanism is located at the first position.

8. The locking socket of claim 1, wherein the pivot portion is located inside a circumference defined by the top face of the shell.

9. The locking socket of claim 1, further including a repositioning mechanism, the repositioning mechanism abutting against the buckle mechanism so that the buckle mechanism tends to return to the first position.

10. The locking socket of claim 1, wherein the buckle mechanism has a protrusion, the protrusion protrudes from the buckle portion away from the side of the buckle portion having the plug holes.

11. The locking socket of claim 9, wherein the buckle mechanism has a protrusion, the protrusion protrudes from the buckle portion away from the side of the buckle portion having the plug holes.

* * * * *